US005309987A

United States Patent [19]

Carlson

[11] Patent Number: 5,309,987

[45] Date of Patent: May 10, 1994

[54] METHOD AND APPARATUS FOR HEATING AND COOLING FOOD PRODUCTS DURING PROCESSING

[75] Inventor: V. R. Carlson, Marion, Iowa

[73] Assignee: ASTEC, Cedar Rapids, Iowa

[21] Appl. No.: 918,209

[22] Filed: Jul. 21, 1992

[51] Int. Cl.[5] ..... F28D 7/00; F28F 9/22

[52] U.S. Cl. ..... 165/159; 165/161; 165/163; 99/470

[58] Field of Search ..... 165/159, 161, 163; 99/470

[56] References Cited

U.S. PATENT DOCUMENTS

| | | | |
|---|---|---|---|
| 3,731,733 | 5/1973 | Trepaud | 165/161 |
| 4,697,636 | 10/1987 | Mellsjö | 165/161 X |
| 4,872,503 | 10/1989 | Marriner | 165/163 X |
| 4,895,203 | 1/1990 | McLaren | 165/163 x |
| 4,998,464 | 3/1991 | Kubacki | 99/455 |

OTHER PUBLICATIONS

Spiratech brochure, undated.

Carlson, V. R., ASTEC brochure entitled "Hydrocoil Heat Exchanger", undated.

Carlson, V. R., "Tubular Heat Exchanger Preserves Particles", *Agricultural Engineering*, 1991.

Carlson, V. R., "Enhancement Of Heat Transfer In Heat Exchangers In Aseptic Processing," paper presented to the American Society Of Agricultural Engineers, 1991 Meeting at Chicago, Dec. 17-20, 1991.

Carlson, V. R., "Scale-Up And Calculation Of New Design Commercial Heat Exchangers Used In UHT Processing Systems," paper to American Society Of Chemical Engineers at Summer Meeting, Aug. 16-19, 1987.

Carlson, V. R., "HydroCoil Heat Exchangers", Paper presented to the Conference For Food Engineering of Mar. 11, 1991.

*Primary Examiner*—John Rivell

[57] ABSTRACT

The present invention relates broadly to methods for heating or cooling a media in a indirect heat exchanger. In a specific embodiment of the invention, the indirect heat exchanger is a shell and tube heat exchanger where the tube is coiled within the shell and the coiled tube includes baffles at least every third coil. The media is passed through the coiled tube and a coolant or heat source flows through the surrounding shell such that the coolant or heat source floods the entire shell. The baffles redirect the coolant or the heat source in such a way as to cause turbulent flow. This turbulent flow allows the heat transfer process to be conducted in a uniform and highly efficient manner.

10 Claims, 2 Drawing Sheets

METHOD AND APPARATUS FOR HEATING AND COOLING FOOD PRODUCTS DURING PROCESSING

BACKGROUND OF THE INVENTION

The present invention involves a methods and an apparatus for the uniform continuous heating and cooling of materials through the use of indirect heat exchangers. The present invention has particular application in the field of heating and cooling of liquid or semi liquid food products that include solid particles. Examples of such food products include yogurt fruit, spaghetti sauce, and various fruit products such as jams. There is often a need to heat or cool these products for both safety and processing reasons. In many of these circumstances the solid particles are of a fragile nature. In the past the heating or cooling of these materials has been a problem because the solid particles have been bruised or damaged thereby reducing the quality and value of the final product.

Because of these concerns many food processors have had to rely upon batch processing in order to produce a high quality product. Batch processing has the inherent problem of being slow and representing a bottle neck in the processing chain. Moreover, in both the batch processing and continuous processing there was a problem of uniformly heating both the liquid portion of the material and the solid particles. Conventional agitation to equalize temperature face the risk of damaging the solid particles. Therefore, there is a need for a method and apparatus that can continuously and uniformly heat or cool liquid materials containing solid particles.

SUMMARY OF THE INVENTION

The present invention relates broadly to methods for heating or cooling a media in a indirect heat exchanger. In a specific embodiment of the invention, the indirect heat exchanger is a shell and tube heat exchanger where the tube is coiled within the shell and the coiled tube includes baffles at least every third coil. The media is passed through the coiled tube and a coolant or heat source flows through the surrounding shell such that the coolant or heat source floods the entire shell. The baffles redirect the coolant or the heat source in such a way as to cause turbulent flow. This turbulent flow allows the heat transfer process to be conducted in a uniform and highly efficient manner. In addition, the ratio between the radius of the coil and the diameter of the tube forming the coil (r/D) is such that a Dean Effect is produced in the media flowing through the coil. This Dean Effect causes a secondary flow pattern or turbulence in the media within the coil.

The efficiency of the heat transfer and the effect upon the medium can be controlled by varying the r/D ratio, the velocity of flow, the pressure drop through the system, the operating temperatures and the tube wall thickness. Other factors may also influence the design of the system including the nature of the material to be processed. Moreover, these factors can affect each other, i.e., velocity and viscosity will affect the pressure drop through the system.

The present invention further relates to a heat transfer apparatus employed to perform the method discussed above. In a preferred embodiment of the present invention the apparatus includes an outer shell and a coiled tube within the shell. The preferred r/D of the coil is between 3 and 8. The shell contains baffles at least at every third coil. The baffles are designed to redirect the flow of a coolant or heat source, preferably 180°, so as to create turbulent flow within the shell. The wall of the coiled tube are preferably thin so as to maximize the heat transfer between the coolant or heat source in the shell and a the media within the tube and minimize the heat drain caused by the tube itself. Through the use of this preferred embodiment heat can be efficiently and uniformly transferred to and from liquid media without damage to any solid particles within the media.

It is an object of the present invention to provide a method to continuously, efficiently, and uniformly heat or cool media flowing through a heat exchanger.

It is a further object of the present invention to provide a method for continuously and uniformly heating or cooling a liquid media that contains solid particles without damage to the solid particles.

It is yet a further object of the present object of this invention to provide a method utilizing a tube and shell indirect heat exchanger where the tube is coiled within the shell and the shell has a baffle at least every three coils to heat or cool liquid media flowing through the coil in a uniform and continuous manner, whereby any solid particle within the liquid media are substantially undamaged.

It is still a further object of the present invention to provide a tube and shell heat exchanger wherein the tube is coiled within the shell and the coil has a r/D between 3 and 8 whereby in operation Dean turbulence exist within the liquid media flowing within the tube and heat transfer can occur between the liquid media within the tube and a heat source or a coolant within the shell but exterior to the tube. Such heat transfer obtaining the desired temperature of the liquid medium while not causing any substantial damage to any solid particles within the medium.

These as well as other objects and preferred embodiments of the present invention will become evident from the following detailed description of the invention.

DETAILED DESCRIPTION OF THE INVENTION

Figure 1:
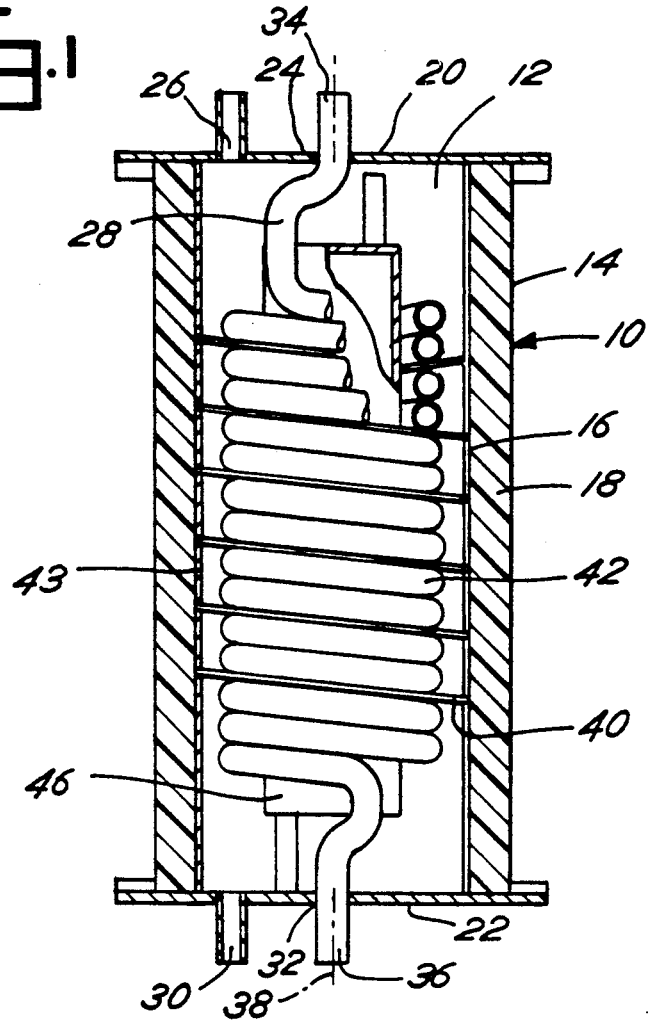
FIG. 1 is a cross section of the heat exchanger embodying the features of the present invention.

As described above the methods and apparatus of the present invention are potentially useful for the heating and cooling of many different products. However, the present invention is particularly useful in the heating and cooling of fluid food products which contain solid particles. These products present special problems because it is important for the marketability of these products that the solid particles pass through the heating or cooling process substantially undamaged. The present invention allows for fast and efficient heating or cooling of these products. The apparatus employed in the method of the present invention is illustrated in FIG. 1.

The apparatus includes an outer shell 10 which defines an enclosed compartment 12. The shell 10 can be any appropriate shape, but it is preferably cylindrical. The shell 10 includes an outer jacket 14 and an inner wall 16. Between the inner wall 16 and the outer jacket 14 is an insulation layer 18 so that the internal temperature of the enclosed compartment 12 can be maintained. The shell 10 is typically from 6 inches to 66 inches in diameter and designed to operate at between 15 to 150 psi.

The shell 10 also includes a first end 20 and a second end 22. The first end 20 defines a first inlet passage 24 and a first outlet passage 26. An inlet end 34 of a tube 28 passes through the first inlet passage 24. The tube 28 is sealed around its outer periphery to the first end 20 of the shell 10. This seal may be created in any appropriate manner including welding, a packed gland or chalking. The first outlet passage 26 is adapted to allow a fluid within the enclosed compartment 12 to pass through the first end 20.

The second end 22 of the shell 10 defines a second inlet passage 30 and a second outlet passage 32. An outlet end 36 of the tube 28 passes through the second outlet passage 32 of the second end 22. As with the first end 20, the tube 28 is sealed in an appropriate manner about its outer periphery to the second end 22. The second inlet passage 30 is adapted to allow fluid within the enclosed compartment 12 to pass through the second end 22.

The tube 28, passes through the enclosed compartment 12 from the first end 20 of the shell 10 to the second end 22 of the shell 10. Intermediate the first end 20 an the second end 22 the tube 28 forms coils 42. The number of coils 42 and the size of the coils 42 can vary with the needs of the process. The coils 42 are characterized by the ratio of the radius of the coil 42 to the diameter of the tube 28. The ratio is expressed as r/D. In a preferred embodiment of the invention the r/D is between 3 to 8. This preferred range of the r/D ratio allows for optimized turbulence of flow within the tube 28.

In a preferred embodiment of the present invention, tube 28 coils as shown in FIG. 1. Specifically the tube 28 coils about a longitudinal axis 38 of the tube 28. Therefore in one preferred embodiment of the present invention the coils 42 are centered on a line extending from the first end 20 of the shell 10 to the second end 22 of the shell 10. Other constructions are possible for example the tube 28 may coil in a direction transverse to the ultimate path of the tube 28. In other words the coils 42 could be centered on an axis transverse to the tube 28.

The size of the tube 28 necessary is dependant on the process being performed. For example if large quantities of media is desired to be passed through the apparatus then the tube 28 should be sized accordingly. Similarly, if the fluid passing through the tube 28 has large particles then the tube 28 must be sized to accommodate the size of the particles. It is important that the tube 28 be sized to maximize heat transfer to the treated media rather than the tube 28 itself acting as heat sink. The tube 28 is typically has a diameter of ¼ inches to 3 inches, however this can vary with application. The wall thickness of the tube 28 is one factor that dictates this efficiency. Chart 1 below outlines the maximum wall thickness for various tube sizes. It is important to recognize these are maximums and that thinner walls should be employed if possible. In selecting the thickness of the tube wall, the pressure at which the system will operate and the diameter of the coil 42 are important. Care must be taken that flattening or wrinkling of the tube 28 does not occur which could increase the pressure drop in the tube, harbor unwanted contaminants and create difficulty in cleaning the tube 28. Moreover, deformation could adversely affect the flow pattern within the tube 28 in turn, adversely affecting the heat transfer.

CHART I

MAXIMUM TUBE WALL THICKNESS

| Tube O.D. | Maximum Wall Thickness |
|---|---|
| ¼–½ in. | 0.83 in. |
| ¾–1 in. | .120 in. |
| 1¼–1½ in. | .200 in. |
| 2–2½ in. | .218 in. |
| 3–4 in. | .300 in. |

Baffles 40 are located within the shell 10. The baffles 40 extend the entire width of the enclosed compartment 12 substantially transverse of the coils 42 of the tube 28. In a preferred embodiment the baffles 40 are not attached to the shell 10 or the coils 42. The baffles 40 are held in position by their interaction with the coils 42 and with an anti-rotation bar 43. Specifically, a notch 45 in the baffle 40 fits about the anti-rotation bar 41 keeping the baffle 40 from rotating and the coils 42 keep the baffles 40 from moving laterally. Such an arrangement allows for easy removal and disassembly for repair.

Figure 2:
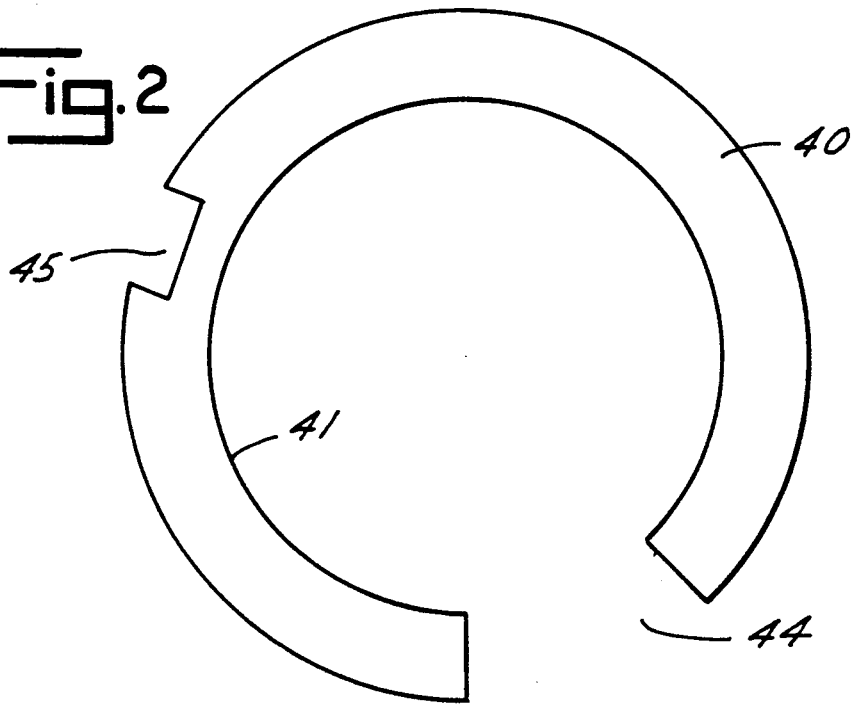
FIG. 2 is top plan view of the baffle arrangement of an embodiment of the present invention.

Individual baffles 40 are shown in FIG. 2. Each baffle 40 defines a port 44 that allows fluid within the enclosed compartment 12 to flow from one baffle 40 to the next. The baffles 40 are arranged so that the flow of any fluid through the enclosed compartment 12 is redirected form one baffle 40 to the next. This redirection is accomplished by altering the location of the port 44 of one baffle 40 with respect to the location of the ports 44 of the two adjacent baffles 40. One purpose of altering the location of the ports 44 is to create turbulence within any fluid flowing from one baffle 40 to the next. The ports 44 are designed so that when the enclosed compartment 12 is completely flooded, turbulence exist in the area of the tube 28. This turbulence enhances the efficiency and the uniformity of the heat transfer. Any scheme of port 44 location that accomplishes this effect would be appropriate. In a preferred embodiment of the invention, the ports 44 of adjacent baffles 40 are staggered 180°.

FIG. 2 also illustrates the notch 45 on the baffle 40. The location of the notch 45 with respect to the port 44 will vary depending on the desired location of the port 44 with respect to ports 44 of the adjacent baffles 40.

The baffles 40 are preferably designed in such a way that they create turbulent flow and a reasonable pressure drop with respect to the flow of fluid through the enclosed compartment 12. When larger diameter shells 10 are used, the baffles 40 are preferably located at every second coil 42. When smaller diameter shells 10 are used the baffles 40 are preferably located at every third coil 42.

At the center of the enclosed compartment 12, within the coils 42, is located a core 46. The core 46 is a cylindrical member placed on the longitudinal axis 38 of the coils 42. The inner circumference of the coil 42 does not touch the core 46, i.e., the coils 42 are free standing. This allows the fluid within the enclosed compartment 12 to completely encompass the coil 42. The inner circumference 41 of the baffles 40 are in contact with the core 46. Through this arrangement the flow of a fluid within the enclosed compartment 12 is directed around the outer edge of the core 46 through the baffle ports 44.

The materials used in the manufacture of the apparatus will vary depending upon the application. However it is important that the material be of such a nature as to not contaminate the media within the tube 28. In the area of food processing the choice of materials is rather limited and the preferred materials are 316 stainless steel and 316L stainless steel tubing. In other application the use of copper or aluminum may be appropriate.

Operation of the apparatus of the present invention has significant benefits, in the food processing area, over the conventional tube in tube heat exchangers and scraped surface heat exchangers of the prior art. These benefits include both safety and operational advantages. The safety advantages come from the fact that the apparatus of the present invention is easy to clean and sterilize and eliminates many of the problem spots for bacterial contamination. Operational benefits include a surprisingly more efficient heat exchanger.

In operation, the media to be heated or cooled flows through the tube 28. A heat source or coolant flows through the enclosed compartment 12 over the baffles 40. The direction of these two flows can be concurrent or counter current. However the direction of the flow is preferably counter current. In an application particularly appropriate for the apparatus of the present invention the media flowing through the tube 28 is a fluid food product containing solid particles. Food products are heated and cooled for various reasons during processing including the inactivation of microorganisms present in the product.

The heat source and coolant particularly preferred for use in the present apparatus are pressurized hot and cold water respectively. Other agents can be used but its preferred that these agents be liquid in form. To the extent the method involves heating or cooling of food products, the heating or cooling agent should be of such a nature as to not contaminate the food product. The use of steam is not preferred because it does not provide as many available BTU's as pressurized hot water. The available BTU's in steam come from the sensible and latent heat of condensing steam. Pressurized hot water has more BTU's from the sensible heat alone if a sufficient amount of water is present. A flow of 150 gal/min or more of pressurized hot water provides sufficient sensible heat. Of course the amount of water necessary will depend on the particular application. For a discussion on the use of pressurized hot water as a heat source see Tanner et. al., "Conserving Fuel by Heating with Hot Water Instead of Steam", *Process Heat Exchange Chemical Engineering*, p. 567 (1976), which is incorporated herein in its entirety.

The use of a fluid heat source rather than steam provides another benefit to the present invention. The flow of the media through the coils 42 tends to create pulsations. The liquid surrounding the coil 42 dampens this pulsation. Without this dampening, the coils 42 are under undue stress and may fail in a relatively short period of time.

For the apparatus of the present invention to perform at maximum efficiency the flow of both the media within the tube 28 and the heat source or coolant should be "plug" flow. "Plug" flow is intended to mean that the tube 28 and the enclosed compartment 12 are completely flooded with the respective fluids. More specifically there should be little or no head space within the tube 28 or the enclosed compartment 12. Operation in this manner ensures that the coil 42 is completely surrounded by the heat source or coolant for maximum heat transfer and the presence of Dean Effect turbulence within the coils 42 for uniform heat transfer within the media.

Figure 3:
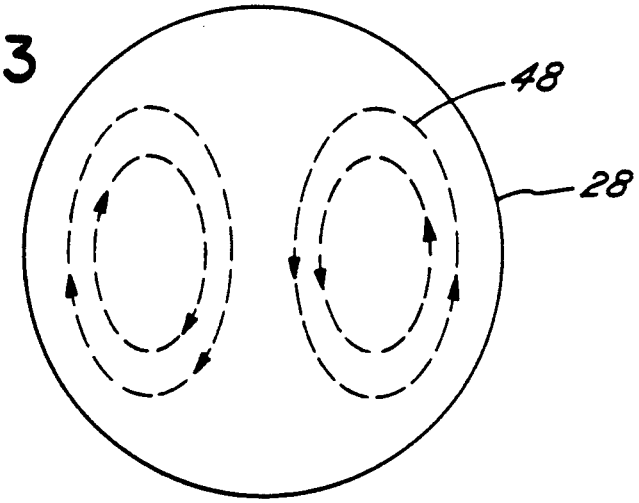
FIG. 3 is a cross section of the coil tube illustrating the Dean turbulence associated with the present invention.

The turbulence of the Dean Effect is Illustrated in FIG. 3. As can be seen the Dean Effect is a secondary flow pattern 48 within the tube 28. The Dean Effect takes place in both laminar flow (usually experienced in viscous products) and turbulent flow (usually fluid products). The Dean Effect creates a turbulence within the flow of the media that increases the heat transfer to the media. It also provides a method for maintaining the distribution of particles within the media. With out the Dean Effect particles would tend to settled, float or be subject to various flow variations due to drag forces.

The efficiency of the apparatus is dependent on many variables. These variables include velocity of flow of media to be treated, velocity of flow of the heat source or coolant, respective temperatures, pressure drop within the heat exchanger and the nature of the media being treated.

The minimum velocity of the flow of the media within the tube 28 for operation within the present invention is one foot per second. Below this level the Dean Effect is not present, turbulent heat transfer is minimal and maintaining a constant proportion of particles to liquid is impossible. Products that contain fragile particle such as chopped tomatoes and whole raspberries may generally be processed at velocities of three to four feet per second, without significant damage to the particles. However, depending on the nature of the fluid (i.e. the carrier and the percentage of the particles) the pressure drop through the system may become so great the particle will be physically abused and lose its shape. In these circumstances a preferred upper limit of velocity on fluids containing fragile particles would be three feet per second. Chart 2 below defines preferred velocities for various treated media.

CHART 2

PREFERRED VELOCITIES FOR VARIOUS MEDIA

| Product | Velocity |
|---|---|
| Products w/particles | 1-3 ft/s |
| Heat sensitive products | 10-15 ft/s |
| Standard fluid products (juices, ice cream mix, etc.) | 3-9 ft/s |
| Fluid products that become more viscous (cheese sauce, puddings, etc.) | 2-5 ft/sec |

As can be seen from Chart 2 the velocity will vary with the nature of the product. Fluid products that do not contain particles such as milk, ice cream mix, juices, cheese sauce, puddings and other sauces may have velocities as high as fifteen feet per second. These high velocities are especially appropriate for heat sensitive products, i.e. liquid eggs, to obtain the maximum heat exchange rate possible with a minimum amount of heating time.

This reduction in the heating time reduces fouling problems. Fouling occurs when deposits of the media within the tube 28 build up on the inner wall of the tube. This obstructs the flow of the media and reduces the efficiency of heat transfer. Fouling problems can also be minimized by incorporating a fouling factor into the design of the apparatus. This fouling factor may result in as much as 2 or 3 times more heat exchange surface than is minimally required. For example if a product can be heated from the incoming temperature to the final temperature in five seconds, then incorporating a fouling factor of two would increase the heating time to ten seconds. Care must be taken, however, not to adversely affect the odor, color or flavor of the media through over heating.

The recommended flow rates for water through the enclosed compartment 12 for both heating and cooling are displayed in Chart 3 below. The water flow varies directly with the flow rate of the product.

CHART 3

PREFERRED VELOCITY OF WATER AS A HEAT SOURCE OR COOLANT AS COMPARED TO THE FLOW OF TREATED MEDIA

| Product Flow Rate | Water Flow Rate |
|---|---|
| 100–200 gpm | 1,000–2,000 gpm |
| 50–100 gpm | 1,000 gpm |
| 20–50 gpm | 600–1,000 gpm |
| 5–20 gpm | 200–600 gpm |
| .5–5 gpm | 50–200 gpm |

When the apparatus of the present invention is operated in accordance with the method of the present invention there is a dramatic increase in the heat transfer rate over that previously available in the prior art. Heat transfer efficiency increases of 200% to 400% have been experienced. The heat transfer rate in the present invention can be 300 BTU/hr./sq.ft/°F. Additionally, the present invention can be operated with a U-factor of 80 to 1000, dependent on the viscosity of the medium being treated. Thin liquids can have a U-factor in the range of 800–1000 BTU/hr./sq.ft./°F. In more viscous endothermic liquids, the U-factor can drop to the range of 80–100 BTU/hr./sq.ft./°F. The invention is very versatile and has been used for heating products over a wide range of temperature. For example, cheese sauce, pudding and ice cream mix have been heated from 40° F. to 300° F. and liquid eggs have been heated from 35° F. to 162° F.

Figure 4:
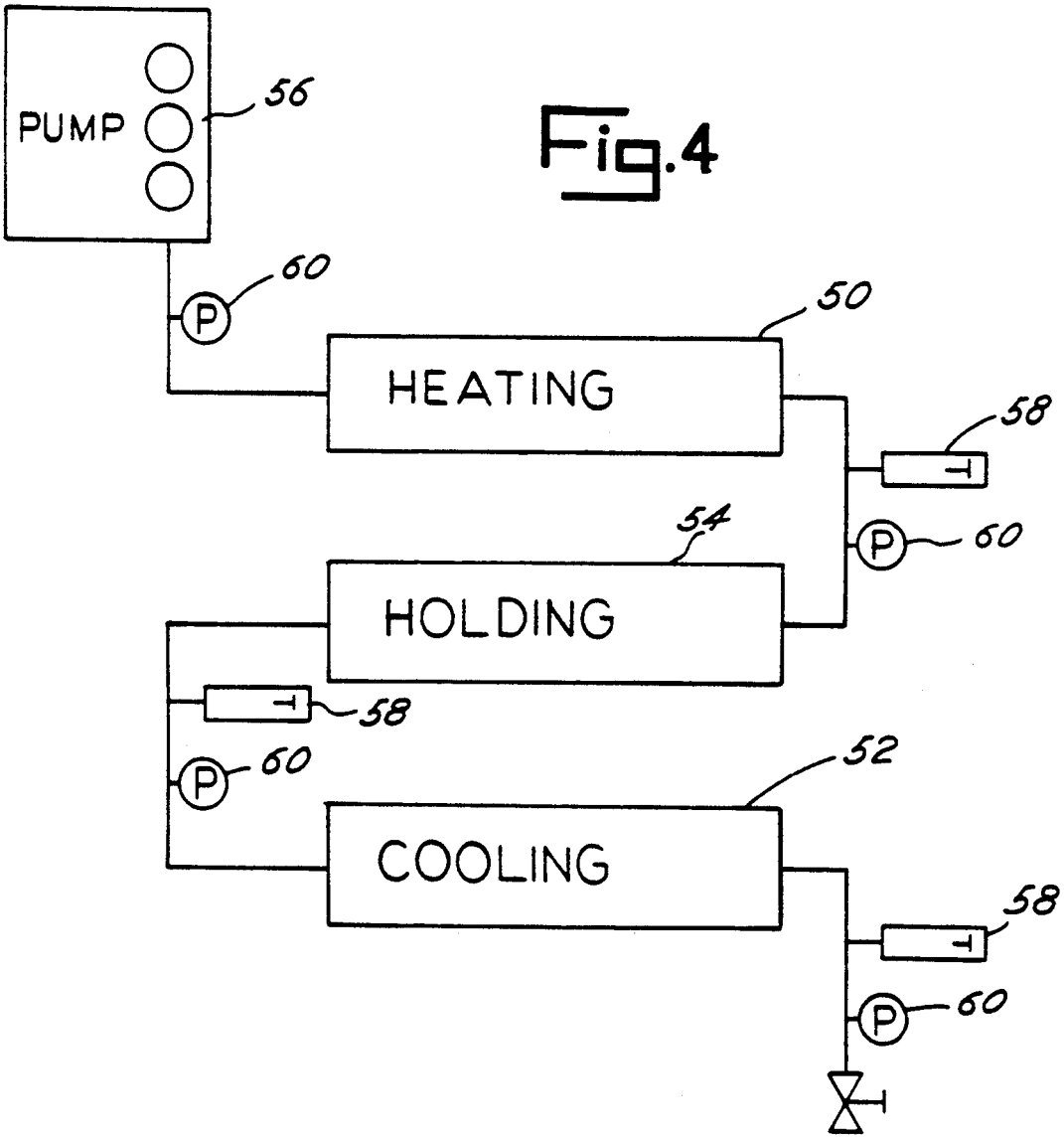
FIG. 4 shows the apparatus of the present invention in a standard system for treating food products.

The operation of the present invention in a system as shown in FIG. 4, where the apparatus of the present invention can be either the heating section 50 or the cooling section 52 or both. In the system of FIG. 4 a pump 56 forces the media to be treated through the heating section 50, a holding section 54 and a cooling section 52. Intermediate of each section is a temperature gauge 58 and a pressure gauge 60 that allow the parameters of the system to be monitored and maximize its efficiency. This system will provide uniform and efficient heating of the media. This is true even when the product contains solid particles. In the prior art there had been a problem making the temperature of the surrounding fluid consistent with the temperature of the solid particles. This was evidenced by variations in temperatures of media leaving the heat exchanger and a variation in temperature from the media entering the holder 54 and that leaving the holder 54. In the present invention a uniform temperature is obtained. This is evidenced by the same temperature at the inlet of the holder 54 and the outlet of the holder 54 even after a holding time of six minutes.

This description is intended to only provide a complete description of the preferred embodiment of the present invention and not in any way limit the scope of the invention. The scope of the invention is only intended to be limited by the following claims.

I claim:

1. A method for heating fluid food products containing solid particles for purposes of processing, comprising:

flowing the food product through a coiled tube in a plug flow manner at a velocity of at least 1 foot per second such that Dean Turbulence are present in the flow of the food product, said coiled tube having an r/D ratio between 3 and 8;

flowing hot water under a pressure of between 15 and 150 pounds per square inch in a turbulent flow manner through a shell surrounding the coiled tube wherein the pressurized hot water substantially fills the entire shell and comes into heat transfer contact with the entire outer surface of the coiled tube, said shell including a center core within the coiled tube but not in contact with the coiled tube, where the hot water flows between the inner surface of the shell and the outer surface of the core, said shell further including baffles which extend substantially from the inner surface of the shell to the outer surface of the core and define a baffle port that allows the water to flow from one baffle to the next, said baffles being positioned at least at every third coil and in such a manner that the direction of flow of the pressurized hot water is changed and the flow is turbulent;

whereby the fluid food product is uniformly heated and any solid particles within the fluid are substantially undamaged.

2. The method of claim 1 wherein the flow of the pressurized hot water is at least 150 GPM.

3. The method of claim 1 wherein the baffles ports are positioned 180 degrees from the two adjacent baffles.

4. The method of claim 1 wherein velocity of the food product is at least 1 foot per second.

5. The method of claim 1 wherein the coiled tube is free standing thereby allowing the pressurized hot water to completely surround the coiled tube and allowing the coiled tube to be easily removed for cleaning and maintenance.

6. A method for cooling fluid food products containing solid particles for purposes of processing, comprising:

flowing the food product through a coiled tube in a plug flow manner at a velocity of at least 1 foot per second such that Dean Turbulence are present in the flow of the food product, said coiled tube having an r/D ratio between 3 and 8;

flowing cold water under a pressure of between 15 and 150 pounds per square inch in a turbulent flow manner through a shell surrounding the coiled tube wherein the pressurized cold water substantially fills the entire shell and comes into heat transfer contact with the entire outer surface of the coiled tube, said shell including a center core within the coiled tube but not in contact with the coiled tube, where the cold water flows between the inner surface of the shell and the outer surface of the core, said shell further including baffles which extend substantially from the inner surface of the shell to the outer surface of the core and define a baffle port that allows the water to flow from one baffle to the next, said baffles being positioned at least at every third coil and in such a manner that the direction of flow of the pressurized cold water is changed and the flow is turbulent;

whereby the fluid food product is uniformly cooled and any solid particles within the fluid are substantially undamaged.

7. The method of claim 6 wherein the flow of the pressurized cold water is at least 150 GPM.

8. The method of claim 6 wherein the baffles ports are positioned 180 degrees from the two adjacent baffles.

9. The method of claim 6 wherein velocity of the food product is at least 1 foot per second.

10. The method of claim 6 wherein the coiled tube is free standing thereby allowing the pressurized cold water to completely surround the coiled tube and allowing the coiled tube to be easily removed for cleaning and maintenance.

* * * * *